US007889078B2

(12) United States Patent
Hovden

(10) Patent No.: US 7,889,078 B2
(45) Date of Patent: Feb. 15, 2011

(54) MOTION ACTIVATION DEVICE

(76) Inventor: Knut Hovden, Nedre vei 8, NO-3183 Horten (NO)

( * ) Notice: Subject to any disclaimer, the term of this patent is extended or adjusted under 35 U.S.C. 154(b) by 362 days.

(21) Appl. No.: 11/995,160

(22) PCT Filed: Jul. 10, 2006

(86) PCT No.: PCT/NO2006/000265

§ 371 (c)(1),
(2), (4) Date: Jun. 26, 2008

(87) PCT Pub. No.: WO2007/008081

PCT Pub. Date: Jan. 18, 2007

(65) Prior Publication Data

US 2009/0146808 A1 Jun. 11, 2009

(30) Foreign Application Priority Data

Jul. 11, 2005 (NO) ..... 20053351

(51) Int. Cl.
*G08B 13/14* (2006.01)

(52) U.S. Cl. ..... 340/568.1; 340/545.4

(58) Field of Classification Search ..... 340/568.1, 340/568.8, 545.2, 545.4
See application file for complete search history.

(56) References Cited

U.S. PATENT DOCUMENTS 5,258,743 A * 11/1993 Nelson et al. ..... 340/568.1
5,317,304 A 5/1994 Choi ..... 340/571
2003/0062999 A1 * 4/2003 Saleh et al. ..... 340/541
2004/0066302 A1 * 4/2004 Menard et al. ..... 340/669

FOREIGN PATENT DOCUMENTS

GB 2129592 7/1982

OTHER PUBLICATIONS

International Search Report and Written Opinion; PCT/NO2006/000265; pp. 6, Oct. 16, 2006.
International Preliminary Report on Patentability; PCT/NO2006/000265; pp. 4, Jan. 16, 2008.

* cited by examiner

*Primary Examiner*—George A Bugg
*Assistant Examiner*—Kerri McNally
(74) *Attorney, Agent, or Firm*—Baker Botts L.L.P.

(57) ABSTRACT

There is an increase in the number of autonomous battery driven devices in the world today and also a growing need for rapid information of unwanted incidents. By combining the GMS- and GPS-technology with the invention and any sensor with the ability to generate a voltage due to external influences, one has reached an activation device perfect for alarm devices that can lay dormant for years with no mentionable power consumption until the day a certain incident occurs. This trait can be used in numerous applications where only the sensor type sets the limits. By using a piezoelectric gyroscope as sensor for instance, a potent tracking device is made, where motion generates a voltage, which in turn will activate the entire device that will instantly start tracking the movement of the device and report this to its owner. This device will be of very small dimensions it can be attached to or hidden somewhere on personal belongings of a certain size; bags, suitcases, bicycles, paintings etc.

8 Claims, 3 Drawing Sheets

MOTION ACTIVATION DEVICE

CROSS-REFERENCE TO RELATED APPLICATIONS

Figure 1:
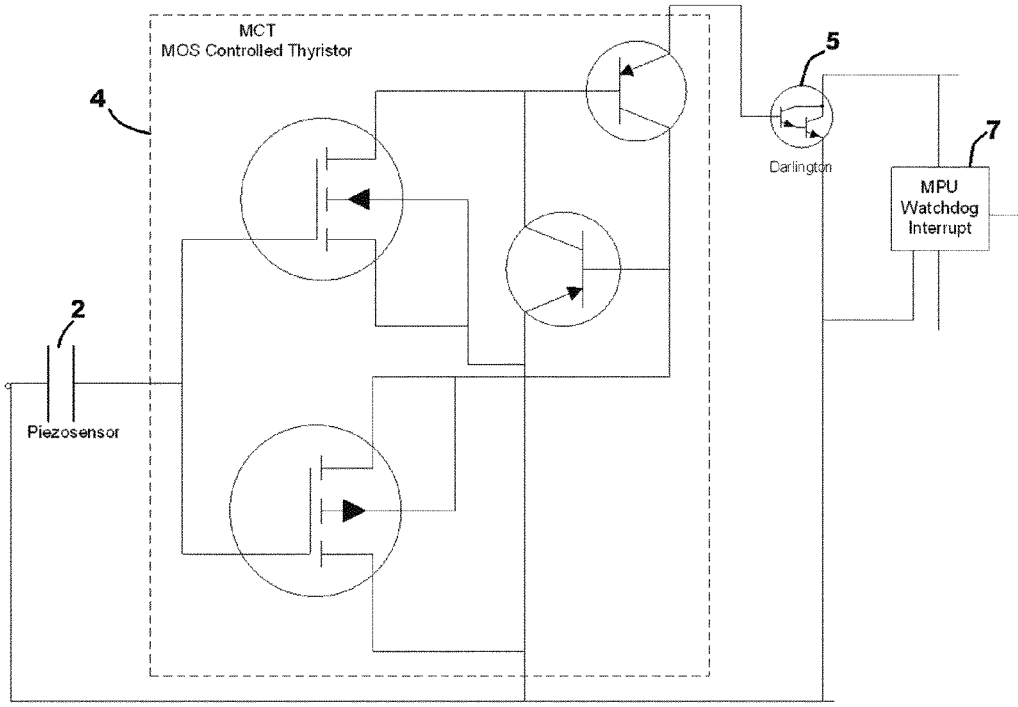

This application is a U.S. national stage application of International Application No. PCT/NO2006/000265 filed Jul. 10, 2006, which designates the United States of America, and claims priority to Norwegian application number NO 2005 3351 filed Jul. 11, 2005, the contents of which are hereby incorporated by reference in their entirety.

TECHNICAL BACKGROUND

Personal belongings are exposed to theft at an increasing rate, while at the same time mobile telephones have become common property. Therefore alarm systems have been commercialized that give alarms for different criteria, amongst which are: sound and pressure wave in connection with a burglary, the opening of doors and windows, motion outside and inside, and proximity to an object, for example a car or a display case. The alarm can be of sound, light or a telephone call to an alarm central or personal telephone number. Advanced car alarms are also connected to the positioning system GPS (Global Positioning System), so that the police or the car's owner can trace a stolen car.

There exist diverse types of sensors and detectors, some of which are for alarms like the ones described above, namely sensors based on the recording of sound or ultrasound, visible light and infrared light (IR and heat radiation), electrical capacitance (proximity sensors) and resistance load change or current interruption (switches), and movement (piezoelectric elements).

Examples one can point to of this are products provided by the companies HiViz and Tainlab, and also commercially available satellite tracking systems for vehicle and transportation surveillance from, amongst other companies, GPS4less, London, Great Britain.

From the patent literature US 2004/0066302A1 is known, it describes registration of movement with the help of a sensor that may be piezoelectric, and the after following signaling with for instance GSM and GPS, but one could say it lacks a controlling/holding mechanism that keeps circuits activated even after signals from the sensor cease. Such a mechanism is on the other hand described for a motion sensor in GB 2129592A, and correspondingly in US 2003/0062999A1, for a sensor apparatus in miniature form, for switching the apparatus between a turned off and an armed position for starting/stopping the motion detection.

GSM and GPS, General

GSM (Global System for Mobile Communication) and GPS are well-tried and standardized radio systems produced by numerous manufacturers. The size of the circuits that handle and interpret GSM and GPS radio signals are today around 7×7 mm.

GSM

The second generation GSM telephones send and receive radio signals on frequencies around 900 MHz.

The components in a standard mobile telephone can be subdivided into five functions:

- An analog to digital baseband processing subsystem (speech to radio signals)
- Layer 1, software (physical layer)
- Layer 2 and 3 (Protocol stack)
- Radio subsystem
- General user interface, software.

A unit that send messages in SMS (Short Message Service) format according to the ETSI's (European Telecommunications Standards Institute) standard for Digital cellular telecommunications system (Phase 2) and by a mobile telephone radio subsystem and software in Layer 1, 2 and 3 is recognized by a GSM-network by the recognition mechanism following the same standard, and the user's SIM (Subscriber Identity Module).

GPS

GPS is the most precise navigational system in the world and comprises 24 satellites, and with the help of only four of these, a user's position on the face of the earth can be calculated precisely. The satellites emit radio signals on frequencies around 1500 MHz. In 2002, Motorola introduced their complete GPS-receiver chip for use in noisy environments, for example in a mobile telephone. A number of other manufacturers produce this kind of chip today and with dimensions in the range of 7×7 mm.

Piezoelectric Gyroscope

Piezoelectric materials produce electrical current when they are deformed by mechanical energy, and vice versa. This trait is used in the construction of a long line of measuring instruments and other products, for example oscillators and clockwork that run on quartz crystals, and motion sensors of the type often used in alarm systems today. A piezoelectric gyroscope use a pressure sensitive element in such a way that it gives off an electrical current when submitted to a physical shock, without necessarily the need for a strong deformation, like being set in motion. Such gyroscopes are mainly used as shock sensors in Hard Disk Drives and portable CD-players. The gyroscope needs no voltage bias to emit its motion generated current and is therefore well suited for units in need of no or almost no power consumption until activation tales place. A modern piezoelectric gyroscope can have dimensions in the range of 6×2 mm.

The Invention's Apparatus in the Shape of a Tracking Unit

By combining the GSM and the GPS technology like the most advanced car alarms do today one has with the invention reached an apparatus in the shape of a motion detection—and tracking unit of so small dimensions that it can be attached to most objects, preferentially hidden, at a comfortable price and with certain features not earlier suggested. Thus one has effective means to secure mobile objects against theft or record and report to where the object is moved. By using a piezoelectric gyroscope to generate an electric current due to motion, such a device can lay immobile, hidden with next to no power consumption until the property it is attached to is set in motion, at which time the GSM and GPS functions are activated and a SMS message with the current position is sent to the owner's mobile phone.

OVERVIEW OF DRAWINGS AND DESCRIPTIONS OF THE INVENTION

Figure 2:
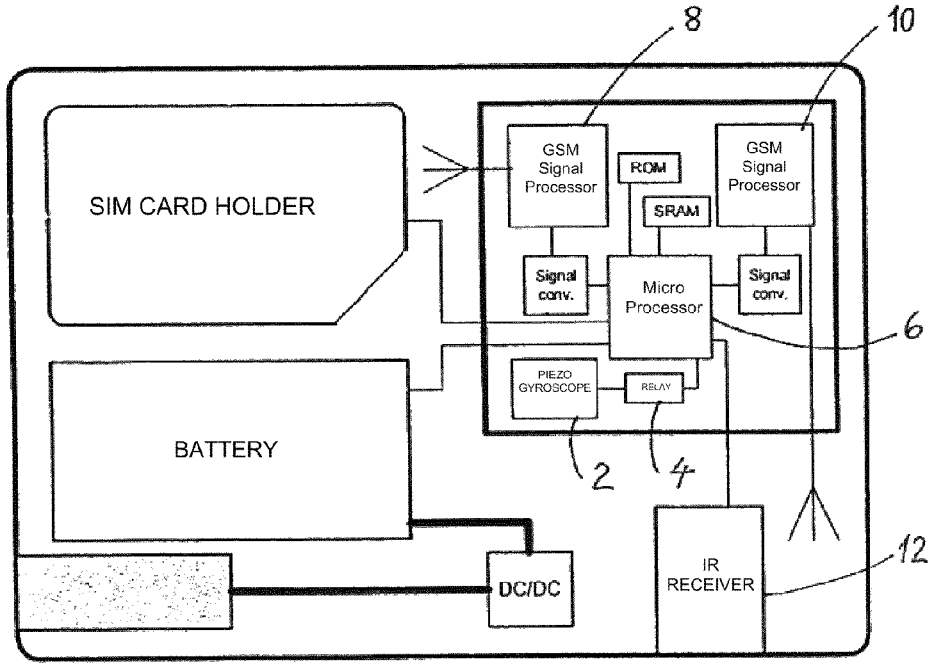
Figure 3:
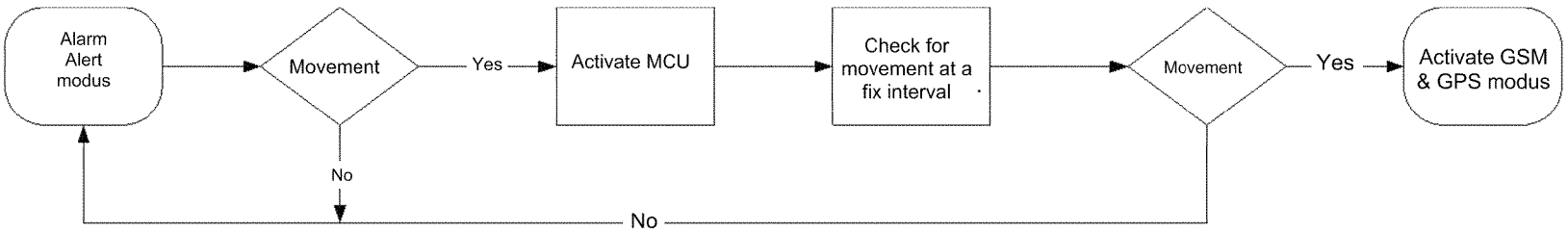
Figure 4:
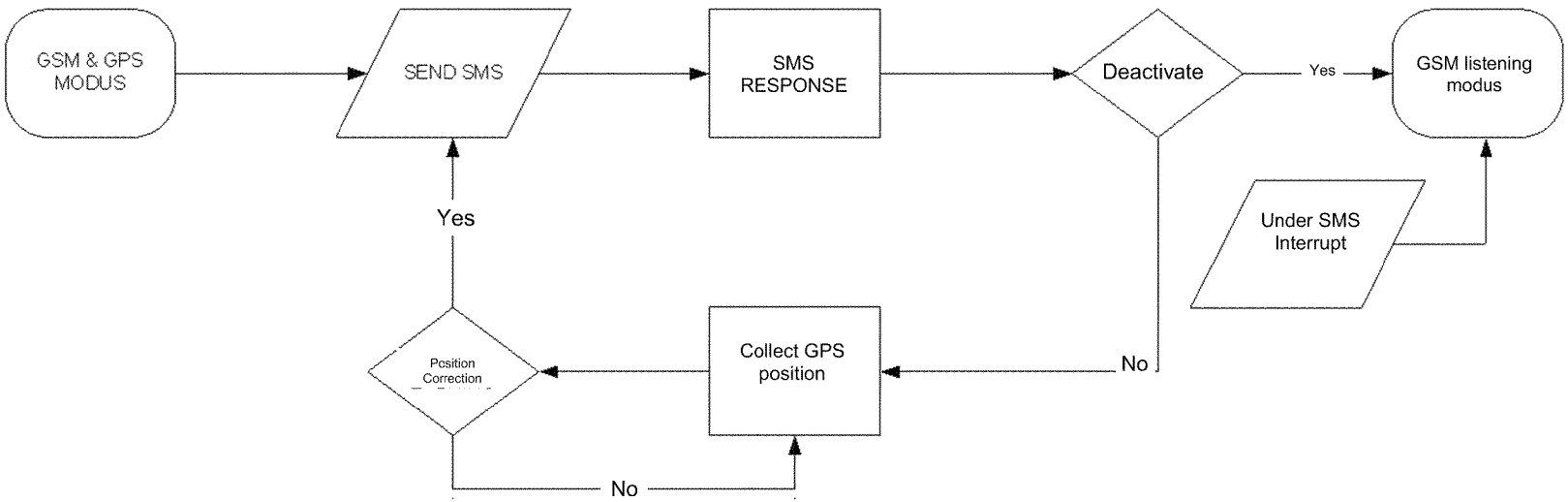

The invention here described is built on the well known technology indicated above and is illustrated by the drawings, where:

FIG. 1 shows a part of an apparatus following the invention, with a sensor connected to amplifier and holding circuits for activation, FIG. 2 displays the apparatus' top view in larger scales with the different circuits and components visible, FIGS. 3 and 4 show how the apparatus functions at activation and deactivation, and FIG. 5 show an apparatus, again in larger scale, with the main components and their interdimensional relationship.

A tracking unit—hereby called an apparatus—that utilize the three above mentioned technologies piezoelectricity, GSM, and GPS can today be constructed with small dimensions and could be used as placement units for all kinds of properties over a certain size. The known mobile messaging service SMS is exploited advantageously so that speech conversion is unnecessary, which today constitute the main part of the GSM components. In this way, the numbers of components are greatly reduced so the unit can be constructed with an area of a matchbox (60×40 mm). By using an all-round microprocessor with several digital inputs and outputs, all data handling can be performed by the same circuit, everything from power control, to GSM and GPS software protocols.

With the invention one has also arrived at an apparatus with the most important features listed amongst the patent claims, a general apparatus for detection of motion, comprising:

a sensor for the generation of an electrical sensor signal due to an external influence, especially a sensor of piezoelectric material where the signal is generated as a result of an deformation of the material due to a force being exerted on it, first circuits with a relay effect and with close to no power consumption in the non-activated state, but with the capacity to activate by a signal from the sensor, then drawing power from a voltage source for the apparatus and at the same time provide current to the succeeding second circuits, and where especially these second circuits encompass a microprocessor for the treatment of the amplified signal and generating commands that involve a control voltage, third circuits for communication of signals based upon the commands and/or the treated sensor signal, and fourth circuits for further communications, wherein:

the first circuits comprise a holding amplifier that can be in two states: 1) a first state—repose state—where its power drain is sufficient for its activation due to a small voltage pulse emitted from the sensor and the amplification of the pulse to activate the second circuits, and 2) a second state—active state—where it consumes power at a higher rate from a nominal power source and a larger amplification, where the transfer from the first to the second state is controlled by the activation of the second circuits, and the second circuits comprise activation circuits which are connected to the sensor and has a security circuit that can be set to block a first activation due to a voltage pulse from the sensor, but thereafter open the blockage and permit a subsequent activation as a result from a second pulse, so to prevent the recording of a movement of the apparatus if certain criteria are not met, and further, that the apparatus includes measures for remote identification for activation/deactivation from a distance.

FIG. 1 shows a part of the electronics inside the tracking unit, the first circuits 4, 5 and 7 for the activation of it, where the source of activation is the piezoelectric sensor 2, especially a piezoelectric gyroscope. The sensor is connected to the first circuit's first part in the form of a holding amplifier (MCT or MOSCT) 4, followed by a second part, an amplifier 5 with a large amplification, for example a Darlington gate as shown in the drawing, and a third part which forms an activation circuit 7 of the type "watchdog", see below. FIG. 1 is a design sketch and does not include the necessary connections and components like diode rectifiers of the sensor signal, the shutting down of the first circuits after activation of the microprocessor, especially with a negative control signal, how the different filter functions are organized, power control functions and so on, since these are considered known techniques for professionals. Activation of the processor will be explained, but the functions that are performed after the activation, are considered to be a known technology.

It is important to note that in the circuit there is no amplification surpassing what is maintained by the direct current source (typically a battery), which is impossible. What the circuit accomplishes is to greatly reduce the voltage in some parts so that there is only a need for a small voltage in the sensor part to control a much larger current in the succeeding circuit, the latter being no larger than the "original" current from the direct current source. This mechanism is added because the external influences—which will act as a voltage source in the sensor part—will seldom generate a voltage of any large degree. For example; a small movement of a piezoelectric element will not generate a large enough voltage on the input (point A) on the first circuit, the holding amplifier.

The sensor is a signal generator that generates an electrical voltage that in turn affects the circuit due to external forces, like light, chemical reactions, temperature, pressure or motion. A sensor of piezoelectric kind is preferred, especially in the shape of a piezoelectric gyroscope.

The shown sensor 2 typically generates a voltage of around 20 micro volts when it is exposed to an acceleration of 1/1000g (1mm/s$^2$), and this voltage has to be amplified up to around 0.5 Volts to be able to activate the unit. As shown in FIG. 1, first a holding amplifier (MCT) 4 of the type MOS Controlled Thyristor (MOSCT) is used (controlled by a field effect transistor part with a metal oxide layer), and this amplifier is composed of a set of transistors that in sum constitutes a switch. A small voltage on the input (by A) can thereby control a larger current over the output (between B and C). The holding amplifier maintains this current even though the externally imposed voltage disappears, and it also has high input impedance. The voltage amplification can be on the order of for example 50-100 times the original input. The holding amplifier 4 needs only a small voltage pulse to activate and therefore functions like a relay (as indicated in FIG. 2), and even if no voltage thereafter is generated from the sensor it will continue to be active, now relying on the current supply, for example a battery.

Thereafter follows a two-step transistor amplifier 5 in cascade or Darlington gate with 1000-10000 times amplification, or in another sense: A small voltage applied to the input in B will control a much larger current on the output (between D and E).

The sensor voltage which after amplification in the amplifier 5 is applied to the succeeding activation circuit 7 in the form of a microprocessor (MPU or CPU, see FIG. 2), with the ability to put it self in a power saving mode know as "deep power down" where the current consumption is reduced to about 1 μA, but it still retains the possibility to be activated by a control voltage on a watchdog port. In an active state the processor-preprogrammed routines run. For instance another port will activate that gives power to an inverting switch that cuts the power to the port while the microprocessor now is powered and active.

Function Description

With the precondition that the processor MPU has closed the circuit down and has gone into repose or "deep power down" mode the following will occur when the sensor is exposed to an external influence, thereby generating a voltage which is amplified in the first circuits 4 (over AB). This voltage closes the circuit's output 4 (between B and C), which is reduced through the reduction circuits (several resistances). The voltage in point B on the output of the circuit 4 activates the amplifier in point 5 (the Darlington gate) which in turn will lead the voltage over DE, which is identical with the input on the processor 7, the watchdog port which is waiting for a signal. When the signal arrives the processor activates and starts its preprogrammed routines.

Now that the processor is working actively, a person must actively seek to return the circuit back to the preceding repose mode, this can be done by a external transmitter unit and an internal receiver connected to the processor or with the ability to transfer the signal to the processor, this can be done with a simple push-button, a radio signal, infrared light, sound signals and more. As long as the internal receiver and external transmitter correspond, this is a way to "arm the activation circuits".

FIG. 2 shows the inventions apparatus or device in a typical design, with its most important components are listed hereunder:

. . . A GSM signal processor 8 with antenna and necessary microelectronics

A GPS signal processor 10 with antenna and necessary microelectronics

A microprocessor 6 with memories of the type ROM and SRAM

SIM cardholder

A battery with connector for external power

A piezoelectric gyroscope 2 with relay and holding amplifiers

An IR-transmitter/receiver 12 (as a possible alternative)

FIGS. 3 and 4 shows the unit functionality. All communication with the unit will be done with SMS messages (or as an alternative with a small remote control in addition, to quickly turn it on or off). The unit has two main functions, one for static use and one for dynamic use.

The static function is used when the unit is supposed to be attached to an object (a piece of property) that is expected to be still for a long period of time, for example a painting, a computer and such, but where the unit will react at once a movement of the object with the attached unit is perceived. When the unit is placed where it should be placed on the object (hidden), the user or installer sends a SMS message with a password and activation text. The GPS position is stored and the unit turns itself almost off, or to a readiness level. The power drain is practically close to zero. If the gyroscope records a movement, for example as a result of trying to remove the property from its place, it gives off a piezoelectric voltage, the unit and its GSM and GPS systems activate, and it sends SMS messages about the property's recorded movement. After a user specified time a new check for movement is performed to exclude any false alarms due to any errors or a random motion detection that nevertheless should not cause activation and the GPS position is controlled against the stored position. If the position is different which indicates that the object or property with the attached unit is moved, SMS messages are periodically sent to the users mobile phone, for continuous tracking of where the unit (and the property) possibly is moved, until it is stationed at a new location which then is located. To save power during longer movements the user can send a SMS message with password and a text to the unit to change its mode of operation to power save mode, which it automatically changes from as soon as is stops moving, then it sends its new position.

The dynamic function is related to use with mobile property, like cars, boats, bicycles, scooters, briefcases and more. The functionality is the same as for the static function as long as the property is standing still, but also the unit has a standby mode where it can communicate with the user by SMS and regularly find its position for comparison with the positions the user has noted. If the user sends a message with the position, it replies, after which time it changes mode to tracking mode. One example is when it is installed in a briefcase that is stolen from where one left it, and one wants to know where the briefcase is transported. The same tracking mode can also be used for all activity where knowing a unit's position is of interest, for example for taxis, police, package shipment and so on.

FIG. 2 shows how the tracking unit can be designed physically.

FIG. 3 displays a block diagram of the apparatus in the form of a tracking unit in a state of readiness. The microprocessor is in its repose state, and its watchdog port is prepared to swiftly activate it, in the case a signal that indicates movement of the unit is obtained. In this repose state the processor draws next to no power (1 μA).

The criteria for which movements that are necessary to start an activation of a GSM and GPS activation/alarm are determined by the activation routines in the microprocessor relating to the piezoelectric gyroscope. The activation routine does not wake the microprocessor completely unless there is a second signal on the watchdog port indicating movement after a preprogrammed time period, to avoid false alarms.

FIG. 4 shows the tracking unit in an active state (GSM and GPS mode). When the criteria for movement are fulfilled, for example after a second movement is recorded, the unit changes to active mode and starts sending SMS-alarms. Then it controls the unit's position by GPS signal comparison against the prior saved position, and more messages are sent if there are position changes. The gyroscope is then no longer in use, since movement registration now is done by GPS. The user can at any time cancel this active mode by sending an SMS to the unit with the right code and command. The block GSM Listening mode indicates that the unit is awaiting further commands from the user, by checking for GSM, SMS messages at a regular interval.

Sensor's of piezoelectric material is know from many different contexts and is also used in the apparatus of the invention. Such sensors have especially suitable for relay—or holding effects where just a small voltage pulse is sufficient to activate other circuits in the apparatus.

Other advantages would be that the system is practically undetectable, which is important in connection with for instance security systems.

The invention is particularly useful for autonomous systems where a chemical battery can seldom or only with difficulty be recharged due to its location, size or the peculiarities of the system involved.

Deactivation of the unit can be reformed by remote control by radio frequency identification (RFID) or by other means, and the unit can be configured to send alarms if it is moved outside the reach of the remote control, particularly with RFID.

In a way, the device functions like a power switch that can activate a superior battery dependent system while at the same time drawing next to no power from that systems battery. Thereby one obtains a main system with an especially long resting or dormant state that can be classified as dead until a sensor signal is generated. When the main system is activated its power is drawn from the battery, the activation circuit does therefore not limit it. The type of sensor used however will define the main system's capabilities to some extents.

Figure 5:
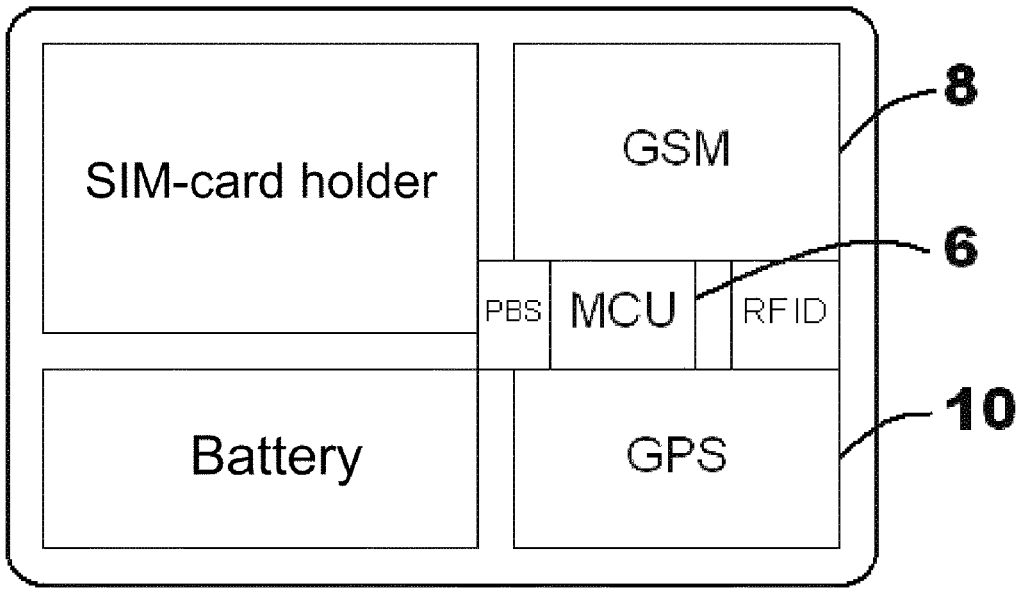

FIG. 5 gives an indication of the interrelationships of component sizes in a typical unit according to the invention. The device may be of a rectangular size with the dimension 60×40 mm and 10 mm thick. Dimensions so small that that the unit may be placed on all types of possessions over a certain size that one would want to protect against theft and recover if such a situation should arise. Bicycles, scooters, motorcycles, all types of suitcases, handbags, camera bags, wallets and paintings are just some examples.

In addition to the main components listed on page 3 the invention's tracking unit has the benefit of a RFID-module, a communications port and a battery recharging port. The advantages that are considered to be unique for the unit are therefore:

Activation/deactivation of a tracking unit with RFID-technology.

Piezoelectric motion detection

No power consumption while in an active state, before the registration of a movement transfers the unit to a state of alert.

Its physical size.

This type of device exists, as mentioned earlier, in other forms; for cars and boats, but there seems that there is no corresponding solution for bicycles, scooters, mopeds, motorcycles and the like. The known solutions are also large and massive and are not suited for use with personal property like bags, suitcases, laptops and so on. No power consumption before a movement sets off the alarm mode makes the tracking unit also suitable for attaching to possessions that are supposed to be motionless for longer periods of time, as in the case of gallery or museum paintings, warehouse goods, stationary computers etc, without needing to change or recharge the power supply, primarily a battery. The tracking unit can be produced at very low costs.

The number of reported thefts in Norway is around 80000 a year, and there is reason to believe that with the invention's tracking unit this amount can be reduced, both by discovering theft at an earlier time and also by being able to trace the stolen goods early, even at a time where the perpetrator is still moving the stolen possession. This can swiftly conclude an investigation of the theft and the thief can be arrested, and he is thereby hindered from repeating the offense for some time. Insurance companies are bound to profit when possessions are recovered not replaced.

The invention's tracking unit is considered to have a great potential market in Norway and worldwide.

The use of the invention's apparatus or tracking unit can be in anything from children's toys to war-material, for instance baby-rattles with light-emitting diodes that blink when the rattle is in use, but where the power almost is turned off until a new movement activates it.

Movement activated landmines is another use where activation is performed with an advanced unit with several sensors and communication-modules so that it can verify that a movement is provoked by an authorized vehicle or not. Movement then does activation and, authorization communication is performed by radio. The communication is predominantly one-way, from the vehicle to the landmine, but a two-way system is preferable with thought to future landmine recovery.

Finally a sensor can be mounted low on a wall in a basement for instance and react to flooding. Such a sensor can be in a repose mode for years and practically use no battery capacity until it is needed.

What is claimed is:

1. An apparatus for registration of motion, comprising:

a sensor for generation of an electrical sensor signal due to external influences, the sensor comprising piezoelectric material where the signal is generated as a result of a deformation of the piezoelectric material due to force being exerted on the piezoelectric material;

first circuits with a relay effect and with substantially no power consumption in a non-activated state and activated by a signal from the sensor, and then drawing power from a voltage source for the apparatus and at the same time providing current to succeeding second circuits;

the second circuits comprise a microprocessor for treatment of an amplified signal and generating commands that involve a control voltage;

third circuits for communication of signals based at least on one of the generated commands and the treated amplified signal; and fourth circuits for further communications;

wherein the first circuits comprise a holding amplifier that can be in two states:

1) a first state—repose state—where a power drain of the holding amplifier is sufficient for activation due to a small voltage pulse emitted from the sensor and the amplification of the pulse to activate the second circuits, and 2) a second state—active state—where the holding amplifier consumes power at a higher rate from a nominal power source and a larger amplification, where transfer from the first to the second state is controlled by the activation of the second circuits, and the second circuits comprise activation circuits which are connected to the sensor and has a security circuit that can be set to block a first activation due to a voltage pulse from the sensor, and thereafter open the blockage and permit a subsequent activation as a result from a second pulse, so to prevent recording of a movement of the apparatus if certain criteria are not met, and further, the apparatus includes measures for remote identification for activation/deactivation from a distance.

2. The apparatus according to claim 1, wherein the measures for remote identification include circuits for activation of the first circuits as a result of incoming infrared light rays on the apparatus.

3. The apparatus according to claim 1, wherein the measures for remote identification are arranged to be able to activate an alarm if the apparatus is moved outside a reach of a remote control.

4. The apparatus according to claim 1, wherein the measures for remote identification include radio frequency circuits for activation or deactivation by radio frequency identification (RFID).

5. The apparatus according to claim 1, wherein the second circuits are arranged for sending and receiving commands by way of the third circuits and a global system for mobile communication.

6. The apparatus according to claim 1, wherein the fourth circuits are arranged to receive signals from a global positioning system GPS.

7. The apparatus according to claim 1, wherein commands to or from the apparatus are in the form of short messages based on small message service SMS for mobile telecommunications, particularly GSM.

8. The apparatus according to claim 1, wherein the motion registration includes registration of the sensor and subsequently the movement of the apparatus from one motionless state or a movement of the sensor and thereby the apparatus from one geographical position to another position.

* * * * *